US008152502B2

(12) United States Patent
Nakamura et al.

(10) Patent No.: US 8,152,502 B2
(45) Date of Patent: Apr. 10, 2012

(54) SCROLL COMPRESSOR HAVING GUIDE RING SUPPORTING AND URGING SEAL MEMBER

(75) Inventors: Satoshi Nakamura, Shizuoka (JP); Mutsunori Matsunaga, Shizuoka (JP); Takeshi Tsuchiya, Tsuchiura (JP); Yuuichi Yanagase, Namegata (JP); Masatsugu Chikano, Shizuoka (JP)

(73) Assignee: Hitachi Appliances, Inc., Tokyo (JP)

( * ) Notice: Subject to any disclaimer, the term of this patent is extended or adjusted under 35 U.S.C. 154(b) by 530 days.

(21) Appl. No.: 12/379,637

(22) Filed: Feb. 26, 2009

(65) Prior Publication Data

US 2009/0246059 A1 Oct. 1, 2009

(30) Foreign Application Priority Data

Mar. 31, 2008 (JP) ..... 2008-089185

(51) Int. Cl.
*F03C 2/00* (2006.01)
*F03C 4/00* (2006.01)
*F04C 18/00* (2006.01)

(52) U.S. Cl. ..... 418/55.5; 418/55.4; 418/57; 277/611; 277/638

(58) Field of Classification Search ..... 418/55.1–55.6, 418/57, 270, 88, 94, 142, 144; 277/611, 277/638, 641, 644
See application file for complete search history.

(56) References Cited

U.S. PATENT DOCUMENTS 4,082,484 A * 4/1978 McCullough ..... 418/55.4
4,199,308 A * 4/1980 McCullough ..... 418/55.4
5,342,066 A * 8/1994 Henley et al. ..... 277/329
7,066,410 B2 * 6/2006 Ruthardt et al. ..... 239/533.11

FOREIGN PATENT DOCUMENTS

JP 09-112458 5/1997

* cited by examiner

*Primary Examiner* — Theresa Trieu
(74) *Attorney, Agent, or Firm* — Antonelli, Terry, Stout & Kraus, LLP.

(57) ABSTRACT

A scroll compressor includes a fixed scroll, an orbiting scroll, a crankshaft rotationally supported on a frame to drive the orbiting scroll, a seal member between an orbiting scroll back surface and the frame, a back pressure chamber of discharge pressure at an inner peripheral side of the seal member, another back pressure chamber of low pressure at an outer peripheral side so that the orbiting scroll is pressed against the fixed scroll with the pressures of these back pressure chambers, and a guide ring supporting an end surface of the seal member at a side opposite to the orbiting scroll and including a guide portion guiding an inner peripheral surface of the seal member so that the seal member is brought into close contact with the orbiting scroll back surface by a wave spring through the guide ring.

7 Claims, 6 Drawing Sheets

SCROLL COMPRESSOR HAVING GUIDE RING SUPPORTING AND URGING SEAL MEMBER

BACKGROUND OF THE INVENTION

The present invention relates to a scroll compressor in which a fixed scroll and an orbiting scroll are meshed with each other, a back chamber filled with oil (refrigerating machine oil) and a gas refrigerant is provided on an end plate back surface of one of the aforementioned scrolls, and the one scroll is pressed against the other scroll by the pressure of the back chamber.

A scroll compressor has a structure in which a compressing mechanism unit constituted of a fixed scroll, an orbiting scroll and the like, and a drive unit which drives the compressing mechanism unit are included, the aforementioned compressing mechanism unit and drive unit are housed in a hermetic chamber, a back pressure chamber filled with oil and a gas refrigerant is provided on a back surface of one of the aforementioned scrolls, the back pressure chamber is at an intermediate pressure between a discharge pressure and an intake pressure of the compressor, and the aforementioned one scroll is pressed against the other scroll. Further, there is also a scroll compressor of the structure in which the aforementioned back pressure chamber is configured by a space at the intake pressure or the intermediate pressure and a space at the discharge pressure, and the aforementioned one scroll is pressed against the other scroll with the total sum of the intake or intermediate pressure and the discharge pressure. In the latter, in order to separate the space at the intake or intermediate pressure and the space at the aforementioned discharge pressure, a seal member is provided. In the scroll compressor, the aforementioned seal member restrains the refrigerant and refrigerating machine oil from moving to the space at the intake or intermediate pressure from the space at the discharge pressure, and the aforementioned seal member is adjusted so that the moving amount becomes a suitable value for enhancing efficiency and securing reliability of the compressor.

As the prior art of this kind, there is the one described in JP-A-09-112458.

BRIEF SUMMARY OF THE INVENTION

FIG. 2 shows an example of the structure of the periphery of the aforementioned seal member in the conventional scroll compressor having the aforementioned seal member 202 for partitioning the back pressure chamber into a space (back pressure chamber) 111 at an intake pressure or an intermediate pressure and a space (back pressure chamber) 112 at a discharge pressure.

In FIG. 2, reference numeral 7 denotes a frame with a casting as a material, a grove 7*a* is formed in the frame 7, and the seal member 202 and a wave spring 203 are provided in this groove. In the seal member 202, the discharge pressure acts on an inner peripheral surface and a bottom surface of the seal member, the seal member is pushed up to an upper portion, and a top surface of the seal member is pressed against an orbiting scroll 5 to be in close contact with the orbiting scroll 5, and an outer peripheral surface of it is pressed against the aforementioned frame 7 to be in close contact with the frame 7. Thereby, the space at the intake pressure or the intermediate pressure and the space at the discharge pressure are configured to be partitioned. An internal wall portion 204 of the frame is between the inner peripheral surface of the seal member and a crankshaft (drive shaft) 8. When the internal wall portion 204 is not present, the seal member 202 and the crankshaft 8 are in contact with each other, and it is conceivable that the seal member wears and breaks. Thus, the internal wall portion 204 performs the function of preventing wear and breakage of the seal member. In FIG. 2, reference numeral 10 denotes an end plate of the orbiting scroll 5, and reference numeral 201 denotes a communication hole which allows the compression chamber at the intermediate pressure formed by the fixed scroll and the orbiting scroll and the aforementioned back pressure chamber 111 at the low pressure side to communicate with each other.

Today, further improvement in performance, reduction in weight and compactness are required of scroll compressors, and with this, for the components configuring the compressors, the functions equivalent to or higher than the present level, and compactness are required. When a scroll compressor is made compact, reduction in the diameter of the seal member is required by reduction in the outside diameter of the scroll member, but in order to ensure reliability, reduction in the diameter of the crankshaft 8 is difficult, and in order to achieve further compactness, the distance between the inside diameter of the seal member 202 and the outside diameter of the crankshaft 8 needs to be made smaller than the present one. Therefore, in order to reduce the diameter of the seal member, the internal wall portion 204 of the frame needs to be made thinner. However, in order to make the internal wall portion 204 which is in the form integrated with the frame 7, machining technique at a high level is required, and even if it can be machined, the number of machining steps increases. Further, since the internal wall portion 204 becomes thin, in order to present breakage, extreme caution is taken when the frame single piece is handled, the frame is in the shape which is not suitable for mass production, and therefore, reduction in the diameter of the seal member is difficult.

An object of the present invention is to provide a scroll compressor which can be made compact by reducing a diameter of a seal member while securing performance and reliability equivalent to the present state, without reducing an outside diameter of a crankshaft.

Another object of the present invention is to provide a scroll compressor capable of securing stable performance and reliability by keeping a seal member stably in close contact with a scroll.

In order to attain the above described object, the present invention is a scroll compressor including a compressing mechanism unit including a fixed scroll and an orbiting scroll, a drive unit having a motor and a crankshaft for driving the orbiting scroll of the compressing mechanism unit, a frame rotationally supporting the aforementioned crankshaft, a seal member annularly sealing a space between a back surface portion of the aforementioned orbiting scroll and the aforementioned frame, a back pressure chamber at a substantially discharge pressure which is formed at a back surface of the aforementioned orbiting scroll and at an inner peripheral side of the aforementioned seal member, a back pressure chamber at a lower pressure than the aforementioned discharge pressure which is formed at the back surface of the aforementioned orbiting scroll and at an outer peripheral side of the aforementioned seal member, and a hermetic chamber housing the aforementioned compressing mechanism unit, the drive unit and the frame, in which the aforementioned orbiting scroll is pressed against the aforementioned fixed scroll with the pressures of the aforementioned back pressure chambers, and is characterized in that a guide ring which supports an end surface of the aforementioned seal member at a side opposite to the orbiting scroll and has a guide portion which is opposed to an inner peripheral surface of the seal member, is placed, a pressing force for bringing the aforementioned seal member into close contact with the back surface of the aforementioned orbiting scroll is given to the guide ring.

In the above description, the back pressure chamber which is formed at the back surface of the aforementioned orbiting scroll and at the outer peripheral side of the aforementioned seal member is a back pressure chamber at an intake pressure, or an intermediate pressure between the discharge pressure and the intake pressure, and the aforementioned orbiting scroll is pressed against the aforementioned fixed scroll with a total sum of the discharge pressure and the intermediate pressure of the aforementioned respective back pressure chambers.

Further, a step portion for housing the aforementioned seal member is provided in the aforementioned frame, and the aforementioned seal member seals the space between the back surface portion of the orbiting scroll and the aforementioned frame by contacting an end surface at an outer peripheral side, of the step portion and the back surface portion of the aforementioned orbiting scroll.

Further, a spring is provided between the aforementioned frame and the aforementioned guide ring, and the aforementioned seal member is further preferably pressed against the back surface of the orbiting scroll via the guide ring with this spring force. Further, an inner peripheral surface of the aforementioned guide ring is placed to be opposed to the outer periphery of the aforementioned crankshaft, and a gap is formed between the aforementioned crankshaft and the guide ring inner peripheral surface.

The aforementioned guide ring is formed into an L-shape, and when an outside diameter of the L-shaped guide ring is set as ϕD, an inside diameter is set as ϕd, an inside diameter of a frame surface with which the outer peripheral surface of the seal member is in contact is set as ϕDf, and an outside diameter of the crankshaft is set as ϕDc, the relationship of the dimensions is set as $$\phi Df-\phi D<\phi d-\phi Dc.$$

As shown in FIGS. 6A and 6B, the aforementioned seal member 2 is configured into a C-shape provided with abutment portions 202*a* cut off from each other to have a very small gap h in a circumferential direction, and when a width of the abutment portion of the seal member is set as B, the aforementioned guide ring outside diameter is set as ϕD, and the inside diameter of the frame surface which the outer peripheral surface of the seal member contacts is set as ϕDf, the relationship of the dimensions is set as $$(\phi Df-\phi D)/2<B.$$

The aforementioned guide ring itself may have the spring function, so that the pressing force for pressing the aforementioned seal member against the aforementioned scroll back surface may be generated with the spring function of the guide ring.

Another characteristic of the present invention is in a scroll compressor including a compressing mechanism unit including a fixed scroll and an orbiting scroll, a crankshaft for driving the orbiting scroll of the compressing mechanism unit, a frame rotationally supporting the crankshaft, a seal member sealing a space between a back surface portion of the aforementioned orbiting scroll and the aforementioned frame, a back pressure chamber at a discharge pressure which is formed at an inner peripheral side of the aforementioned seal member, a back pressure chamber at a low pressure which is formed at an outer peripheral side of the aforementioned seal member, and a hermetic chamber housing the aforementioned compressing mechanism unit, the crankshaft and the frame, in which the aforementioned orbiting scroll is pressed against the aforementioned fixed scroll with pressures of the aforementioned back pressure chambers, a step portion for housing the aforementioned seal member is provided in the aforementioned frame, the aforementioned seal member seals the space between the orbiting scroll back surface portion and the aforementioned frame by contacting the end surface at the outer peripheral side of the step portion and the back surface portion of the aforementioned orbiting scroll, an L-shaped guide ring which supports an end surface of the aforementioned seal member at a side opposite to the orbiting scroll and guides the inner peripheral surface of the seal member is provided, and a pressing force for bringing the aforementioned seal member in close contact with the aforementioned orbiting scroll back surface is given to the guide ring.

According to the present invention, a guide ring (of metal or synthetic resin) which supports the end surface of the seal member, which partitions the back pressure chambers, at the side opposite to the orbiting scroll and has a guide portion opposed to the inner peripheral surface of the seal member, is placed, and the pressing force for bringing the aforementioned seal member into close contact with the aforementioned orbiting scroll back surface is given to the guide ring. Therefore, the seal member can be reduced in diameter without reducing the outside diameter of the crankshaft. As a result, the members around the seal member can be reduced in diameter, and therefore, the scroll compressor can be made compact while ensuring the performance and reliability equivalent to the present state. Further, by providing the guide ring, inclination of the seal member and falling of the abutment portion of the seal member into the valley of the spring can be prevented, and stable performance and reliability can be ensured by keeping the seal member stably in contact with the scroll. The guide ring (of metal and/or synthetic resin different in material from the seal member) may be movable with respect to the frame in the axial direction, may be slightly movable with respect to the frame and/or the seal member in the radial direction perpendicular to the axial direction while being prevented from moving in the radial direction to reach the crankshaft, and/or may be elastically transformable as a spring for urging the seal member in the axial direction when the guide ring is supported on the frame in the axial direction.

Other objects, features and advantages of the invention will become apparent from the following description of the embodiments of the invention taken in conjunction with the accompanying drawings.

BRIEF DESCRIPTION OF THE SEVERAL VIEWS OF THE DRAWINGS

FIG. 4A is a plane view, and FIG. 4B is a vertical sectional view.

DETAILED DESCRIPTION OF THE INVENTION

A scroll compressor includes a seal member which annularly seals a space between a back surface portion of an orbiting scroll and a frame, so that a back pressure chamber at a discharge pressure which is formed at an inner peripheral side of the seal member and is filled with a gas refrigerant at a substantially discharge pressure, and a back pressure chamber at a low pressure which is formed at an outer peripheral side of the aforementioned seal member and is filled with a gas refrigerant at a lower pressure than the aforementioned discharge pressure are partitioned with the seal member. The seal member is conventionally placed by being housed in an annular recessed groove formed in the frame. However, the present embodiment is configured such that the internal wall portion 204 (see FIG. 2) of the annular recessed groove formed in the aforementioned frame is eliminated, an annular L-shaped guide ring is provided as an alternative to it, the aforementioned seal member is held with the guide ring, and a pressing force for bringing the seal member in close contact with the back surface of the orbiting scroll is given to the guide ring.

Hereinafter, based on the drawings, embodiments of the present invention will be described in detail.

Embodiment 1

Embodiment 1 of the present invention will be described on the basis of FIGS. 1, 3 and 4.

Figure 1:
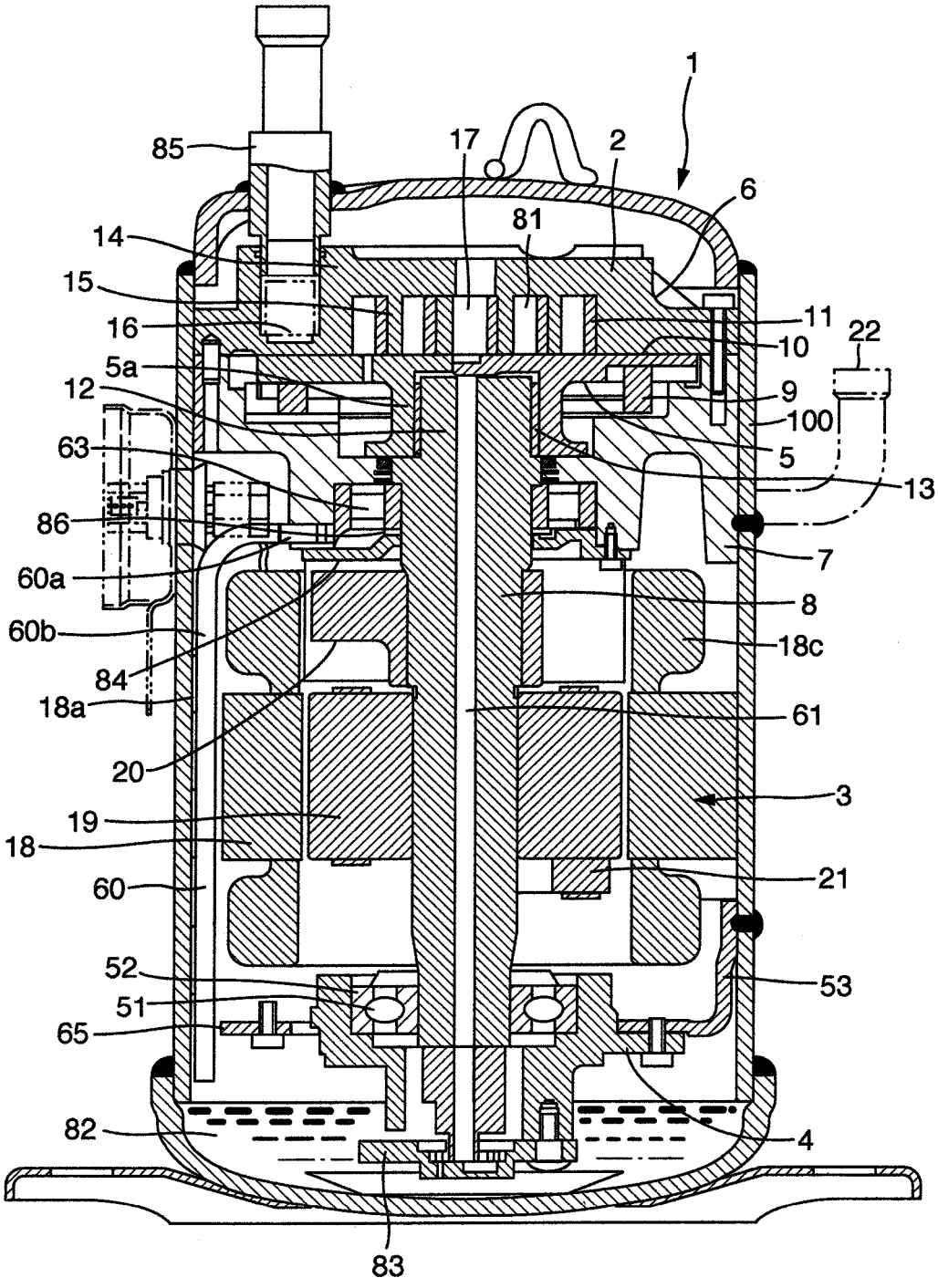
FIG. 1 is a vertical sectional view of a scroll compressor showing embodiment 1 of the present invention.

A scroll compressor in the present embodiment is a vertical type scroll compressor, and is configured by housing a compressing mechanism unit 2, a drive unit having a motor 3 and a crankshaft (drive shaft) 8, a frame 7 in which a main bearing 63 rotationally supporting the aforementioned crankshaft 8 is placed, an auxiliary bearing unit 4 rotationally supporting the aforementioned crankshaft 8, an oil feeding pump 83 and the like in a hermetic chamber 100, as shown in FIG. 1.

The compressing mechanism unit 2 is configured by an orbiting scroll 5, a fixed scroll 6, a frame 7, a crankshaft 8, an orbiting bearing portion 13, an orbiting mechanism (Oldham ring) 9 and the like. Further, in the aforementioned compressing mechanism unit 2, a compression chamber 81 is formed by the aforementioned fixed scroll 6 and orbiting scroll 5 being meshed with each other.

The orbiting scroll 5 includes an involute wrap 11 vertically placed on one side of an end plate 10, and a shaft support portion (boss portion) 5*a*. On a back surface side of the end plate of the orbiting scroll 5, the orbiting bearing portion 13 in which a crank axle 12 of the crankshaft 8 is inserted is provided, and the orbiting mechanism 9 for causing the orbiting scroll to perform orbiting motion is placed.

The fixed scroll 6 includes an involute wrap 15 vertically provided on one side of an end plate 14, an inlet port 16 and an outlet port 17, and is fixed to the frame 7 via bolts. The aforementioned orbiting scroll 5 is held between the fixed scroll 6 and the frame 7 to be capable of orbiting motion. An inlet pipe 85 provided in the hermetic chamber 100 is connected to the inlet port 16 of the fixed scroll 6. Further, the hermetic chamber 100 is provided with an outlet pipe 22 communicating with a space between the frame 7 and the motor 3.

In the frame 7, its outer peripheral portion is fixed to the hermetic chamber 100, and the main bearing 63 is supported at its central portion. Further, the frame 7 covers the main bearing 63 together with a cover 84. The cover 84 is detachably attached to the frame 7 so as to press the main bearing 63 from below. The main bearing 63 is placed between the motor 3 and the orbiting scroll 5.

The crankshaft 8 has the crank axle 12 which is inserted in the orbiting bearing portion 13 of the orbiting scroll, at an upper portion of the main shaft part supported by the main bearing 63 and the auxiliary bearing unit 4, and pivotally supports the orbiting scroll 5 to be able to drive the orbiting scroll 5 to orbit via the crank axle 12.

The motor 3 configures rotary drive means that drives the compressing mechanism unit 2 via the crankshaft 8, and has a stator 18 and a rotor 19 as basic elements. The outer peripheral surface of the stator 18 is mounted to the inner peripheral surface of the hermetic chamber 100 to be substantially in close contact with the inner peripheral surface.

The auxiliary bearing unit 4 supports the crankshaft 8 at the side opposite to the scroll of the motor 3. The auxiliary bearing unit 4 includes an auxiliary bearing 51, an auxiliary bearing housing 52 housing the auxiliary bearing 51 inside, a lower frame 53 connected to the auxiliary bearing housing 52, and the like. The lower frame 53 is fixed to the hermetic chamber 100. The crankshaft 8 is pivotally supported at both sides of the motor 3 by the main bearing 63 and the auxiliary bearing 51, and the crank axle 12 at the upper end is connected to the orbiting bearing portion 13.

When the crankshaft 8 rotates by the rotation of the motor 3, the orbiting scroll 5 performs orbiting motion with respect to the fixed scroll 6 while keeping the posture in which rotational movement is inhibited by the function of the orbiting mechanism 9. In order to cancel off the unbalance force caused by the orbiting motion, a balance weight 20 is attached to between the rotor 19 of the motor and the orbiting scroll 5, and a rotor balance weight 21 is also attached to the aforementioned rotor 19.

In a compression chamber 81 formed by causing the fixed scroll 6 and the orbiting scroll 5 to mesh with each other, its volumetric capacity decreases by the orbiting scroll 5 performing orbiting motion, and compression operation is performed. The compression operation will be described in more detail. With orbiting motion of the orbiting scroll 5, a working fluid (refrigerant) enters an inlet space formed by both the scrolls from the inlet port 16, and when the orbiting motion advances, the aforementioned inlet space becomes a closed space, that is, the compression chamber 81, the aforementioned working fluid which is taken in is discharged to the outlet space in the hermetic chamber 100 from the outlet port 17 of the fixed scroll 6 through the compression process, and is further discharge outside the hermetic chamber 100 from the outlet pipe 22 through the space at the motor chamber side. Thereby, the space inside the hermetic chamber 100 is kept at a discharge pressure.

A lower portion of the aforementioned hermetic chamber 100 forms an oil reservoir 82 in which oil separated from the refrigerant discharged from the aforementioned outlet port 17 accumulates, and an oil feeding mechanism is provided in the oil reservoir to supply oil for lubricating the aforementioned main bearing 63, the auxiliary bearing 51, the orbiting bearing portion 13 and the sliding surfaces of the aforementioned both scrolls and the like. The oil feeding mechanism is configured by the oil feeding pump 83 provided at a lower end of the crankshaft 8, an oil feeding hole 61 formed in the crankshaft, an oil drain pipe 60 for returning the oil lubricating the aforementioned orbiting bearing portion 13 and the main bearing 63 to the aforementioned oil reservoir 82 and the like. The aforementioned oil feeding pump 83 is for forcefully supplying the lubricating oil stored in the oil reservoir 82 to the auxiliary bearing 51, the orbiting bearing portion 13 and the main bearing 63 through the aforementioned oil feeding hole 61. Further, part of the oil after lubricating the aforementioned orbiting bearing portion 13 also leaks and flows into the aforementioned back pressure chamber 111 at the low pressure side from a part of the aforementioned seal member 202. The oil flowing into the back pressure chamber 111 lubricates the sliding surfaces of the orbiting scroll 5 and the fixed scroll 6, flows into the aforementioned compression chamber 81 through the aforementioned communication hole 201 and the like, lubricates the sliding surfaces of the wraps 11 and 15 of both the scrolls 5 and 6, and thereafter, is discharged from the aforementioned outlet port 17 together with the refrigerant gas. Near the aforementioned auxiliary bearing 51 of the aforementioned oil feeding hole 61, a lateral oil feeding hole (not illustrated) communicating with the auxiliary bearing 51 is formed in the crankshaft 8, so that oil is also fed to the auxiliary bearing 51.

The aforementioned oil drain pipe 60 is provided in a cutout portion (recessed portion) 18*a* formed on an outer periphery of the stator 18 of the motor 3, and guides the oil which lubricates the main bearing 63 to the oil reservoir 82 at the lower portion of the hermetic chamber 100. A circular hole is formed in the portion of the frame 7 which covers the main bearing 63, and an end portion formed in a cylindrical shape of an upper end side horizontal portion 60*a* of the aforementioned oil drain pipe 60 is press-fitted in and fixed to the circular hole. By the fitting structure, the oil drain pipe 60 can be easily and reliably fitted to the frame 7. The end portion of this oil drain pipe 60 is opened between the lower portion of the main bearing in the frame 7 and the aforementioned cover 84, so that the oil lubricating the main bearing 63 flows into the oil drain pipe 60.

A vertical portion 60*b* of the oil drain pipe 60 vertically extends along the inner wall surface of the hermetic chamber 100, passes between an end coil portion 18*c* of the stator 18 and the hermetic chamber 100, and through the outer peripheral recessed portion (cutout portion) 18*a* of the aforementioned stator 18 to extend to the oil reservoir 82 below the motor 3. A lower end portion of the oil drain pipe 60 is fixed by a pipe presser 65 mounted to a lower frame 53.

Figure 3:
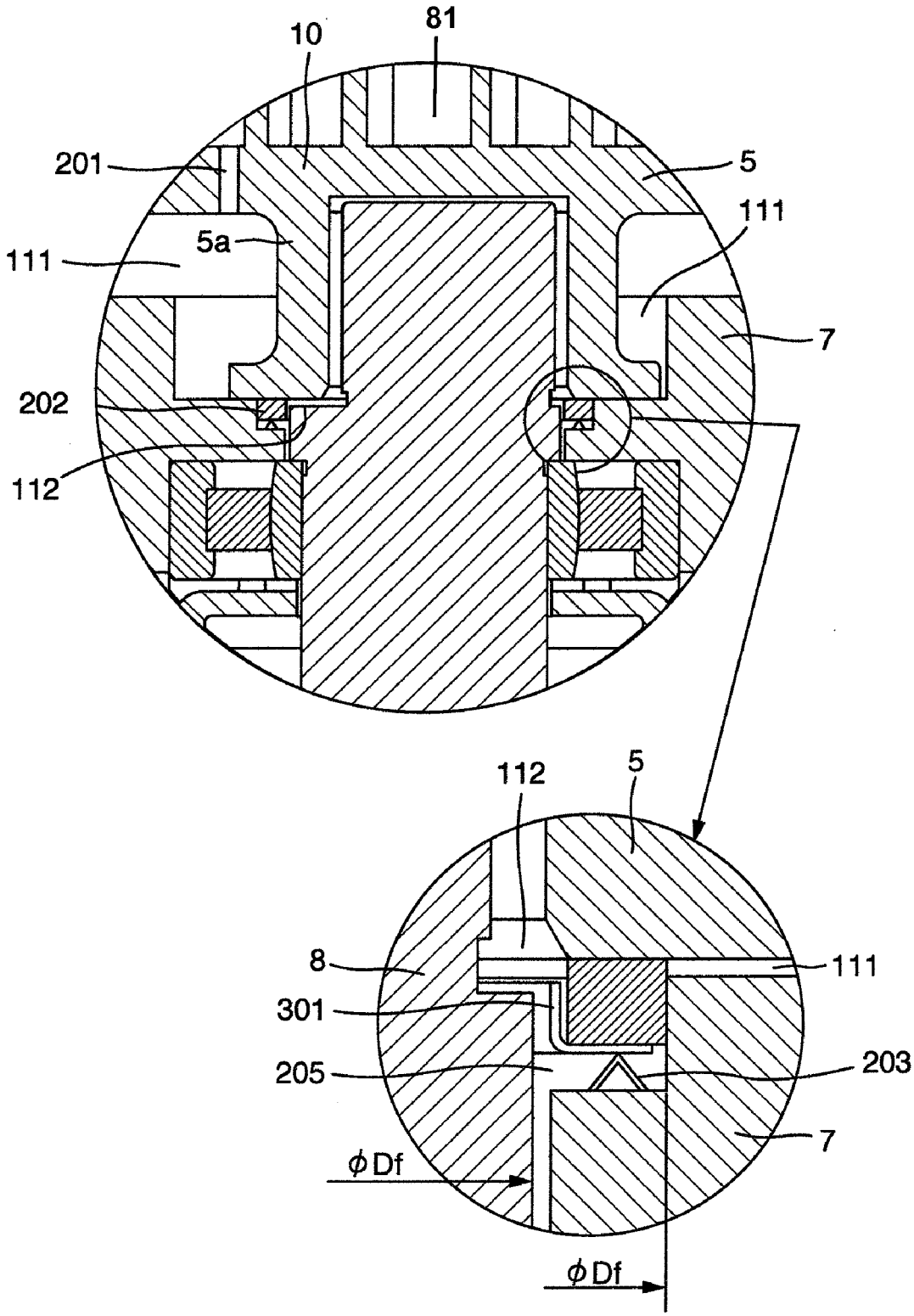
FIG. 3 is an enlarged sectional view of the seal member and its periphery in FIG. 1.

FIG. 3 is an enlarged view of the aforementioned seal member 202 and its periphery. The end plate 10 of the orbiting scroll 5 is provided with a communication hole 201 which allows the compression chamber and the back pressure chamber to communicate with each other, and therefore, the back pressure chamber 111 at the outer peripheral side of the seal member 202 is at an intermediate pressure by the refrigerant gas at an intermediate pressure between the inlet pressure and discharge pressure. Further, a back pressure chamber 112 on the inner peripheral side of the seal member 202 is filled with oil at the discharge pressure inside the hermetic chamber and is at the discharge pressure.

Reference numeral 205 denotes a circular step portion formed at the frame 7 to house the aforementioned seal member 202, and reference numeral 301 denotes a guide ring which supports the end surface of the seal member 202 at the side opposite to the orbiting scroll, and has a guide portion opposed to the inner peripheral surface of the seal member. The guide ring 301 is provided at the aforementioned step portion 205, a wave spring 203 is provided between the undersurface of the guide ring 301 and the step portion 205 of the frame, and the seal member 202 is pressed against the back surface of the orbiting scroll 5, the undersurface of a boss portion 5*a* formed on the back surface of the orbiting scroll in this embodiment, via the guide ring 301 with this spring force.

Further, a gap between the inner peripheral surface side of the seal member 202 and the step portion 205 of the frame is filled with oil and a refrigerant gas at a discharge pressure, and this provides the structure which presses the top surface of the seal member 202 against the back surface of the orbiting scroll 5, and presses the outer peripheral surface of the seal member 202 against the outer peripheral side end surface of the frame step portion 205 to seal the back pressure chamber 111 at the outer side of the seal member and the back pressure chamber 112 at the inner side of the seal member. By the above described structure, the orbiting scroll 5 is pressed against the fixed scroll 6 with the total sum of the intermediate pressure of the back pressure chamber 111 and the discharge pressure of the back pressure chamber 112.

The aforementioned seal member 202 is configured into a C-shape provided with an abutment portion having a very small gap in the circumferential direction, and when the relationship of the dimensions is set as $$(\phi Df-\phi D)/2<B$$

where the width (about ½ of the width in the diameter direction of the seal member) of the abutment portion of the seal member 202 is set as B, the aforementioned guide ring outside diameter is set as ϕD, and the inside diameter of the frame-surface with which the outer peripheral surface of the seal member is in close contact is set as ϕDf, the seal member 202 can be stably held with the guide ring 301.

Figure 4A:
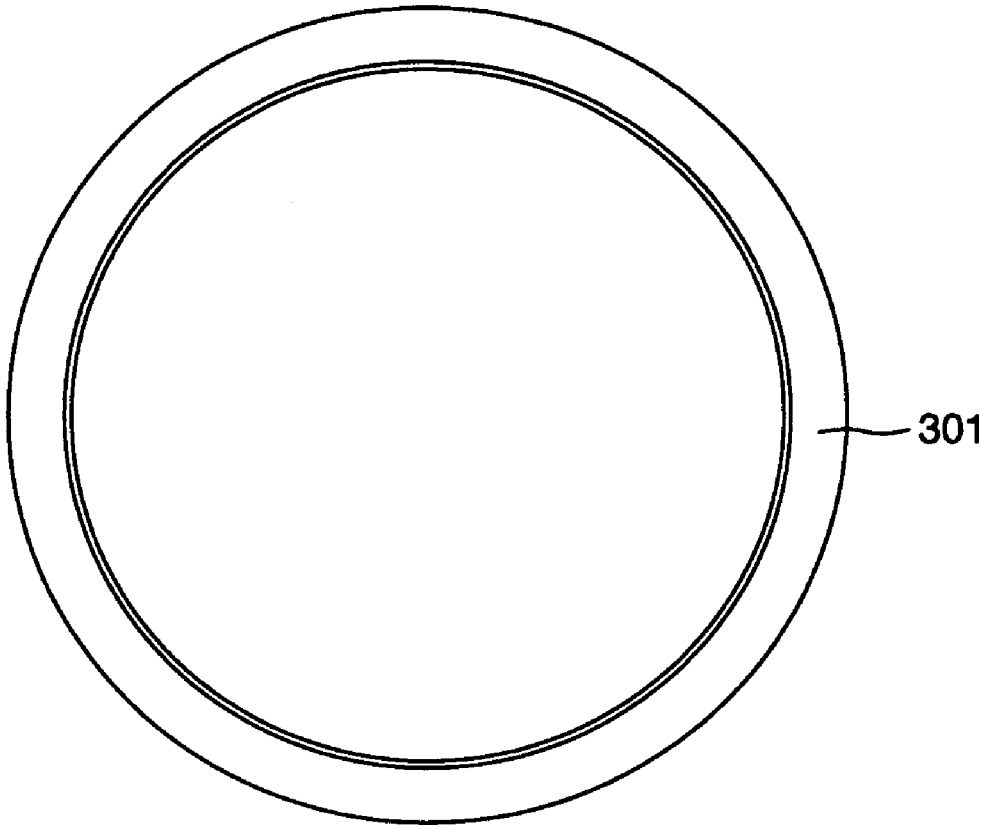
FIGS. 4A and 4B are views showing a guide ring shown in FIG. 3.
Figure 4B:
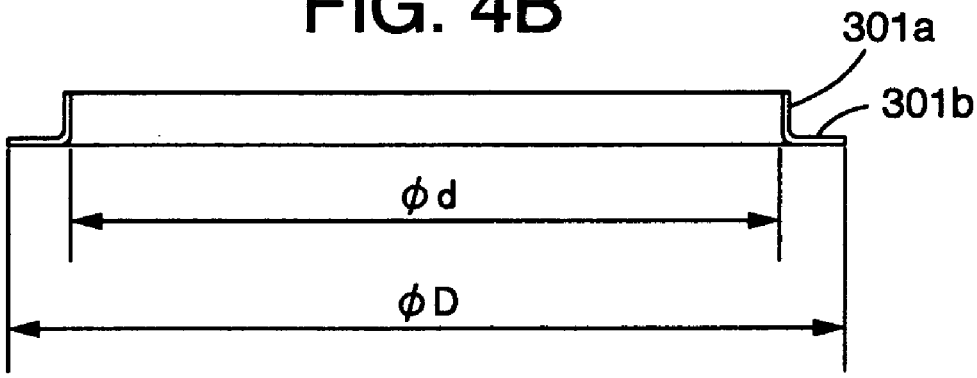

An example of the guide ring 301 is shown in FIG. 4. By forming a thin plate into an annular shape with an L-shaped section by pressing, the guide ring configured by a guide portion 301*a* which becomes an alternative of the frame internal wall portion 204 shown in FIG. 2, and a base portion 301*b* which supports the seal member in the axial direction is produced.

When the outside diameter of the guide ring is set as ϕD, the inside diameter is set as ϕd, the inside diameter of the frame step portion is set as ϕDf, and the outside diameter of the crankshaft is set as ϕDc, they are configured so as to satisfy the relationship of $$\phi Df-\phi D<\phi d-\phi Dc$$

so that the guide ring 301 does not contact the crankshaft 8.

Figure 2:
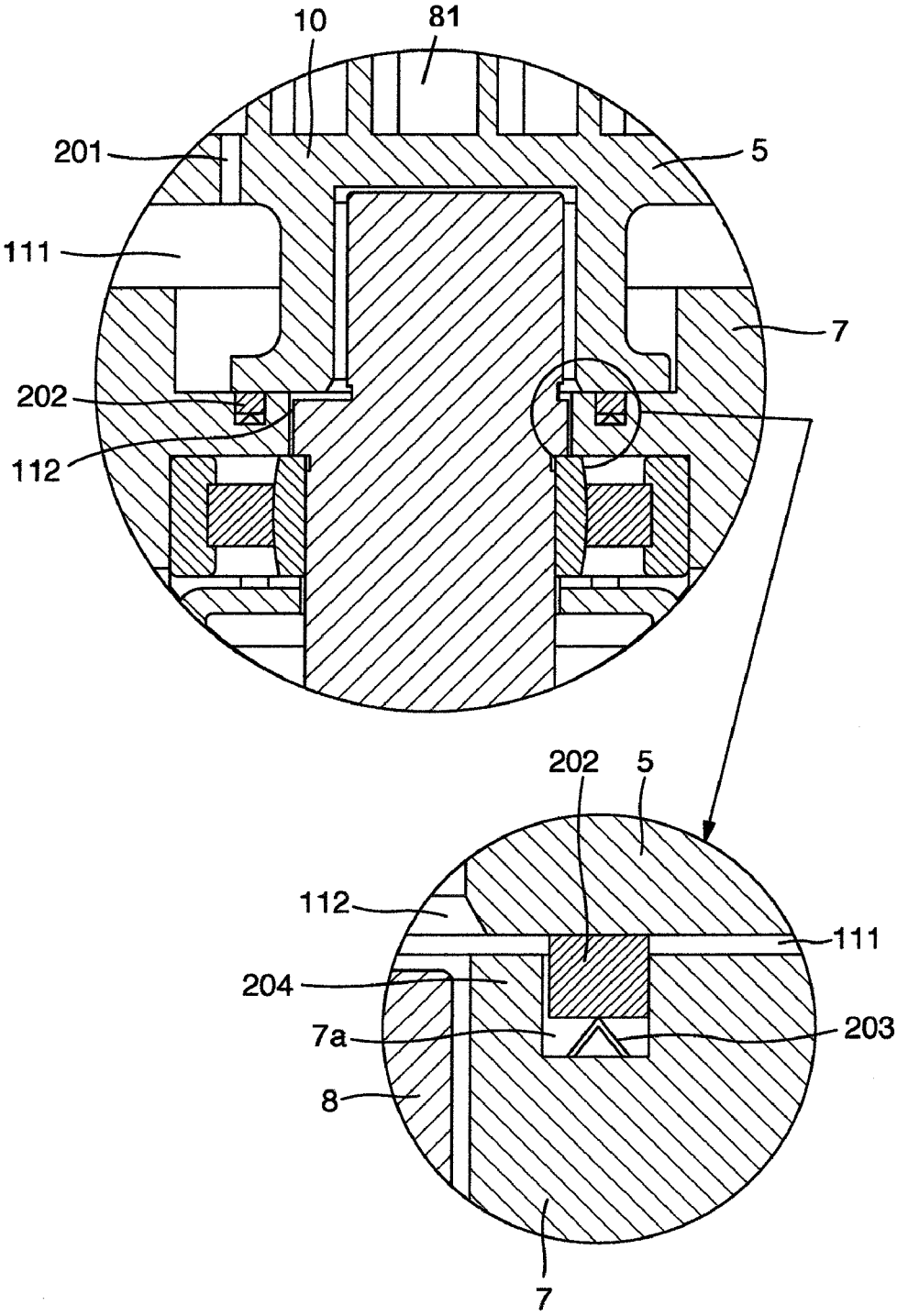
FIG. 2 PRIOR ART
FIG. 2 is a partial sectional view showing a structure example of a seal member and its periphery in the conventional scroll compressor.

As in the present embodiment, by providing the guide ring at the frame step portion housing the seal member, it is not necessary to provide the frame internal wall portion 204 as shown in FIG. 2, as a result of which, the diameter of the seal member can be reduced without reducing the outside diameter of the crankshaft. Accordingly, the diameters of the members around the seal member can be reduced, and therefore, reduction in size and weight of the scroll compressor can be realized while performance and reliability equivalent to the present state are ensured. Further, by providing the guide ring, inclination of the seal member and falling of the seal member abutment portion into the valley portion of the spring can be prevented, and stable performance and reliability can be secured by keeping the seal member stably in close contact with the scroll.

Embodiment 2

Figure 5:
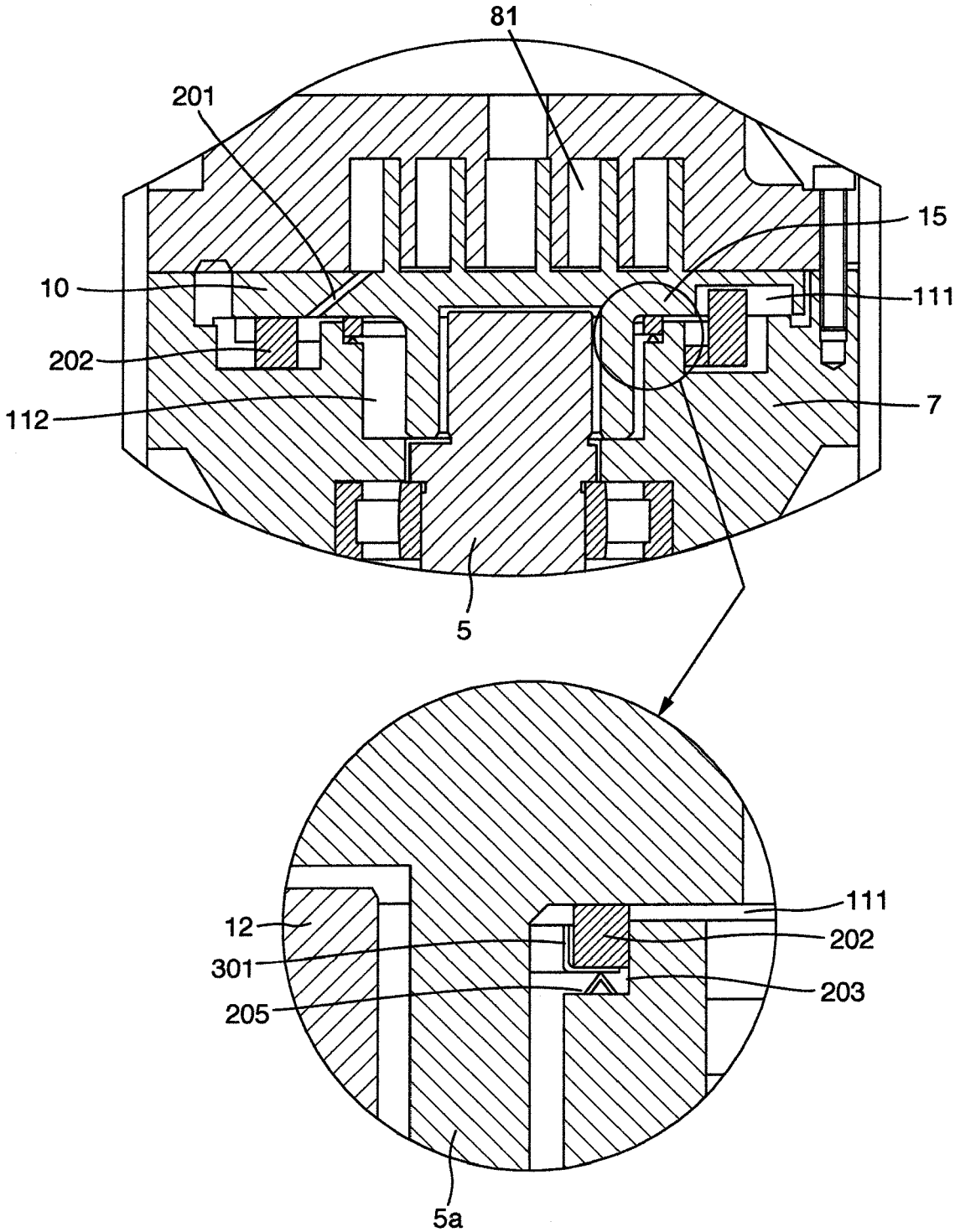
FIG. 5 is a view showing embodiment 2 of the present invention, which corresponds to FIG. 3.
Figure 6A:
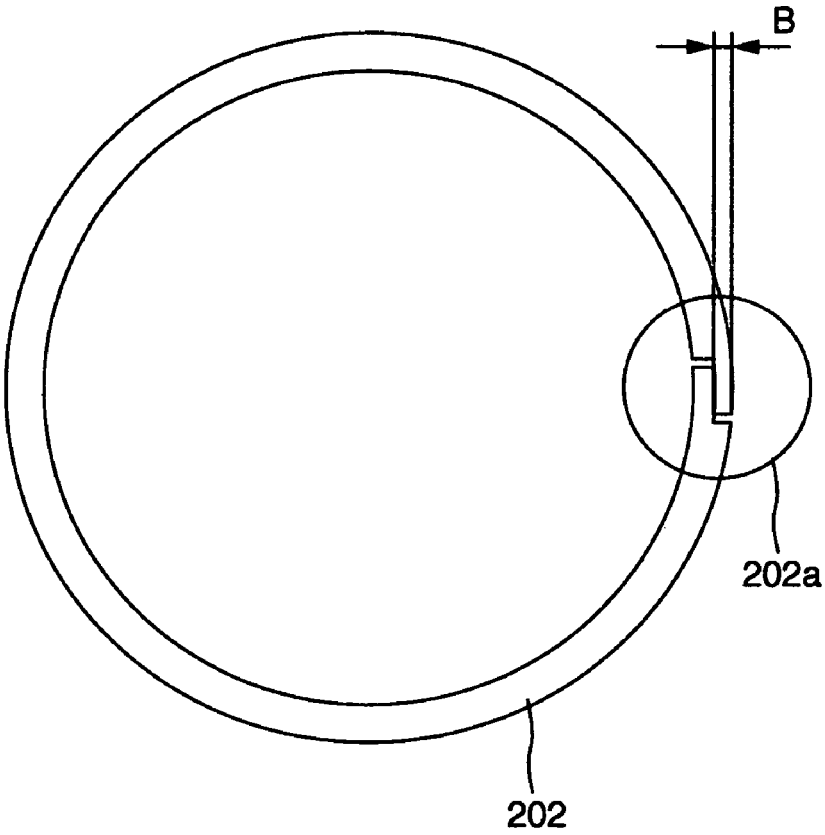
FIGS. 6A and 6B are plane and side views respectively showing the seal member shown in FIG. 3.
Figure 6B:
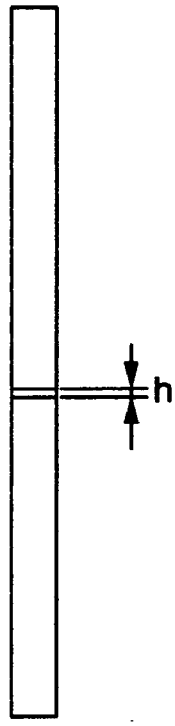

FIG. 5 shows embodiment 2 of the present invention, and is a view corresponding to FIG. 3. In the drawing, the parts assigned with the same reference numerals and symbols as those in FIG. 3 show the same or corresponding parts.

In this embodiment, the step portion 205 is provided in a part of the frame 7 which is opposed to the back surface of the end plate 10 at the outer peripheral side of the boss portion of the orbiting scroll 5, the seal member 202 is provided at the step portion, the seal member is held with the guide ring 301, and the seal member 202 is pressed against the back surface of the orbiting scroll via the guide ring 301 by the wave spring 203 provided between the guide ring 301 and the step portion 205. Further, oil and the refrigerant gas at a discharge pressure are filled in the spaces at the inner side and the lower portion of the seal member 202, and by the discharge pressure, the seal member 202 is also pressed against the back surface of the orbiting scroll, and is also pressed against the end surface at the outer peripheral side of the frame step portion. Accordingly, the back pressure chamber 112 at the discharge pressure at the inner side of the seal member and the back pressure chamber 111 at the intermediate or the inlet pressure at the outer side of the seal member are formed by the seal member 202, and the orbiting scroll 5 is pressed against the fixed scroll 6 with the total sum of the pressures of the back pressure chambers 111 and 112. The other parts are the same as in the above described embodiment 1.

The above describe embodiment adopts the configuration in which the seal member 202 is pressed against the back surface of the orbiting scroll by using the wave spring 203 via the guide ring 301, but instead of providing the wave spring, the guide ring 301 itself may be given the spring function or may be formed monolithically with the wave spring 203, and the seal member may be pressed against the back surface of the orbiting scroll by the spring function of the guide ring.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A scroll compressor comprising:

a compression mechanism including a fixed scroll and an orbiting scroll, a drive mechanism including a motor and a crankshaft to drive the orbiting scroll, a frame for supporting the crankshaft in a rotatable manner, a seal member forming an annular sealing between a back surface of the orbiting scroll and the frame, wherein the frame has a step portion receiving the seal member so that the seal member faces to an outer peripheral surface of the step portion and the back surface to form the sealing between the back surface and the frame, a back pressure chamber defined at least partially by the back surface and an inner periphery of the seal member so that a pressure of discharged fluid is applied to the back pressure chamber, another back pressure chamber defined at least partially by the back surface and an outer periphery of the seal member so that another pressure lower than the pressure is applied to the another back pressure chamber to press the orbiting scroll against the fixed scroll with the pressure of the back pressure chamber and the another pressure of the another back pressure chamber, a hermetically sealed container containing therein the compression mechanism, the drive mechanism and the frame, a guide ring supporting an end of the seal member opposite to an end thereof facing to the orbiting scroll, including a guide portion facing to the inner periphery of the seal member, and urging the seal member to be pressed against the back surface, and a spring between the frame and the guide ring so that the spring presses the seal member against the back surface through the guide ring.

2. The scroll compressor according to claim 1, wherein the another pressure has an intermediate value between the pressure of discharged fluid and a pressure of intake fluid so that the orbiting scroll is pressed against the fixed scroll with a total amount of the pressure of discharged fluid and the another pressure of intermediate value.

3. The scroll compressor according to claim 1, wherein a pressure of intake fluid is applied to the another back pressure chamber so that the orbiting scroll is pressed against the fixed scroll with a total amount of the pressure of discharged fluid and the pressure of intake fluid.

4. The scroll compressor according to claim 1, wherein the guide ring has an elasticity for pressing the seal member against the back surface.

5. A scroll compressor comprising:

a compression mechanism including a fixed scroll and an orbiting scroll, a drive mechanism including a motor and a crankshaft to drive the orbiting scroll, a frame for supporting the crankshaft in a rotatable manner, a seal member forming an annular sealing between a back surface of the orbiting scroll and the frame, wherein the frame has a step portion receiving the seal member so that the seal member faces to an outer peripheral surface of the step portion and the back surface to form the sealing between the back surface and the frame, a back pressure chamber defined at least partially by the back surface and an inner periphery of the seal member so that a pressure of discharged fluid is applied to the back pressure chamber, another back pressure chamber defined at least partially by the back surface and an outer periphery of the seal member so that another pressure lower than the pressure is applied to the another back pressure chamber to press the orbiting scroll against the fixed scroll with the pressure of the back pressure chamber and the another pressure of the another back pressure chamber, a hermetically sealed container containing therein the compression mechanism, the drive mechanism and the frame, a guide ring supporting an end of the seal member opposite to an end thereof facing to the orbiting scroll, including a guide portion facing to the inner periphery of the seal member, and urging the seal member to be pressed against the back surface, wherein an inner periphery of the guide ring faces to an outer periphery of the crankshaft with a clearance therebetween.

6. The scroll compressor according to claim 5, wherein the guide ring has a L-shape, and when an outer diameter of the guide ring is $\phi D$, an inner diameter of the guide ring is $\phi d$, a diameter of the outer peripheral surface of the step portion is $\phi Df$, and an outer diameter of the crankshaft is $\phi Dc$, a relationship of $\phi Df-\phi D<\phi d-\phi Dc$ is satisfied.

7. A scroll compressor comprising:

a compression mechanism including a fixed scroll and an orbiting scroll, a drive mechanism including a motor and a crankshaft to drive the orbiting scroll, a frame for supporting the crankshaft in a rotatable manner, a seal member forming an annular sealing between a back surface of the orbiting scroll and the frame, wherein the frame has a step portion receiving the seal member so that the seal member faces to an outer peripheral surface of the step portion and the back surface to form the sealing between the back surface and the frame, a back pressure chamber defined at least partially by the back surface and an inner periphery of the seal member so that a pressure of discharged fluid is applied to the back pressure chamber, another back pressure chamber defined at least partially by the back surface and an outer periphery of the seal member so that another pressure lower than the pressure is applied to the another back pressure chamber to press the orbiting scroll against the fixed scroll with the pressure of the back pressure chamber and the another pressure of the another back pressure chamber, a hermetically sealed container containing therein the compression mechanism, the drive mechanism and the frame, a guide ring supporting an end of the seal member opposite to an end thereof facing to the orbiting scroll, including a guide portion facing to the inner periphery of the seal member, and urging the seal member to be pressed against the back surface, wherein the seal member has a C-shape including an opened area forming a small clearance, and when a width of the small clearance is B, an outer diameter of the guide ring is $\phi D$, and a diameter of the outer peripheral surface of the step portion is $\phi D$, a relationship of $(\phi Df-\phi D)/2<B$ is satisfied.

* * * * *